US007956303B2

(12) United States Patent
Pehrson

(10) Patent No.: US 7,956,303 B2
(45) Date of Patent: Jun. 7, 2011

(54) MAT SYSTEM AND METHOD THEREFOR

(75) Inventor: Daniel Pehrson, Baxter, MN (US)

(73) Assignee: ATEK Products Group, Brainerd, MN (US)

( * ) Notice: Subject to any disclaimer, the term of this patent is extended or adjusted under 35 U.S.C. 154(b) by 0 days.

(21) Appl. No.: 12/037,239

(22) Filed: Feb. 26, 2008

(65) Prior Publication Data

US 2009/0065344 A1 Mar. 12, 2009

Related U.S. Application Data

(60) Provisional application No. 60/971,808, filed on Sep. 12, 2007, provisional application No. 60/980,295, filed on Oct. 16, 2007.

(51) Int. Cl.
*H01H 9/00* (2006.01)

(52) U.S. Cl. ..... 200/85 R; 200/511; 200/512

(58) Field of Classification Search .... 200/61.41–61.44, 200/511, 512, 85 R, 86 R, 86 A, 85 A
See application file for complete search history.

(56) References Cited

U.S. PATENT DOCUMENTS 3,136,833 A * 6/1964 Wikkerink ..... 264/277
3,323,197 A * 6/1967 Millard ..... 29/622
4,006,392 A * 2/1977 Catlett et al. ..... 318/266
4,220,815 A * 9/1980 Gibson et al. ..... 178/18.05
4,525,606 A * 6/1985 Sado ..... 200/5 A
4,801,771 A * 1/1989 Mizuguchi et al. ..... 200/86 R
4,965,421 A * 10/1990 Epperson ..... 200/514
5,210,528 A * 5/1993 Schulman et al. ..... 340/666
5,401,922 A * 3/1995 Asta ..... 200/5 A
5,911,460 A * 6/1999 Hawkins et al. ..... 292/254
6,072,130 A * 6/2000 Burgess ..... 200/86 R
6,420,974 B1 * 7/2002 Baker et al. ..... 340/666
6,677,542 B2 * 1/2004 Katakami ..... 200/5 A
6,707,386 B1 * 3/2004 Pruisner ..... 340/665
6,777,626 B2 * 8/2004 Takabatake et al. ..... 200/5 A
6,894,682 B2 * 5/2005 Nakajima et al. ..... 345/173
6,917,293 B2 * 7/2005 Beggs ..... 340/573.1
6,965,311 B1 * 11/2005 Kamer ..... 340/539.12
6,987,232 B2 * 1/2006 Smith et al. ..... 200/85 R
7,378,975 B1 * 5/2008 Smith et al. ..... 340/573.1
7,397,466 B2 * 7/2008 Bourdelais et al. ..... 345/173

* cited by examiner

*Primary Examiner* — Michael A Friedhofer
(74) *Attorney, Agent, or Firm* — Schwegman, Lundberg & Woessner, P.A.

(57) ABSTRACT

An apparatus includes a protective covering. An electronics module and a pair of electrodes are disposed within the protective covering. The pair of electrodes is electrically connected to the electronics module. The electrodes are separated by a distance in an open position when unloaded and are configured to contact each other in a closed position when loaded. In one example, a plurality of resilient spacing structures is disposed between the electrodes. The electronics module is configured to obtain electrode position data by determining whether the electrodes are in the open or closed position. In one example, the electronics module is configured to remotely communicate the electrode position data. The electrodes and electronics module are embedded within the protective covering, which is integrally molded therearound.

28 Claims, 3 Drawing Sheets

MAT SYSTEM AND METHOD THEREFOR

RELATED APPLICATIONS

This application claims priority under 35 U.S.C. 119(e) from U.S. Provisional Application Ser. No. 60/971,808, filed Sep. 12, 2007, entitled "MAT SYSTEM AND METHOD THEREFOR", and U.S. Provisional Application Ser. No. 60/980,295, filed Oct. 16, 2007, entitled "MAT SYSTEM AND METHOD THEREFOR", the disclosures of which are incorporated herein by reference.

TECHNICAL FIELD

This invention relates to switch mats. Specifically, this invention relates to switch mats for use in determining the presence or absence of a person, object, etc.

BACKGROUND

Presence-sensing mats are useful, for instance, to trigger automatic doors to open or close when stepped upon. Such devices can be found at doors to buildings, such as stores, airports, and hotels, for instance. Presence-sensing mats are also useful in other situations, such as industrial safety applications in which mats can sense whether a person or object is within a safe zone or, alternatively, an unsafe zone during operation of a machine. Such mats can be configured to enable the machine if the person or object is within the safe zone or disable the machine so as to not operate while a person or object are within the unsafe zone.

Such mats typically include electrodes within the mat but control and other electronics contained separately outside of the mat and connected to the electrodes with one or more wires exiting from the mat. Such a configuration requires not only the mat, but also the separate electronics, to be protected in a resilient, moisture-resistant manner. Several disadvantages are associated with this configuration, including excess cost in manufacturing, increased susceptibility to moisture and other environmental hazards, decreased reliability, increased trip hazard and distance limitations due to wires connecting various components, and the like.

Other devices, such as sensor systems, are used to sense the presence of a person or object, for instance, to automatically open a door or the like. However, such systems have many disadvantages. For instance, such systems are costly to install and maintain; are subject to improper functioning if the sensors become misaligned, mis-calibrated, or otherwise malfunctioning; and are subject to phantom activations, such as activations from blowing debris or people or objects passing by within the sensed zone.

What is needed is an improved mat system. For example, a mat system and method that provides a relatively self-contained, moisture-resistant, reliable, presence-sensing mat.

DETAILED DESCRIPTION

Figure 1:
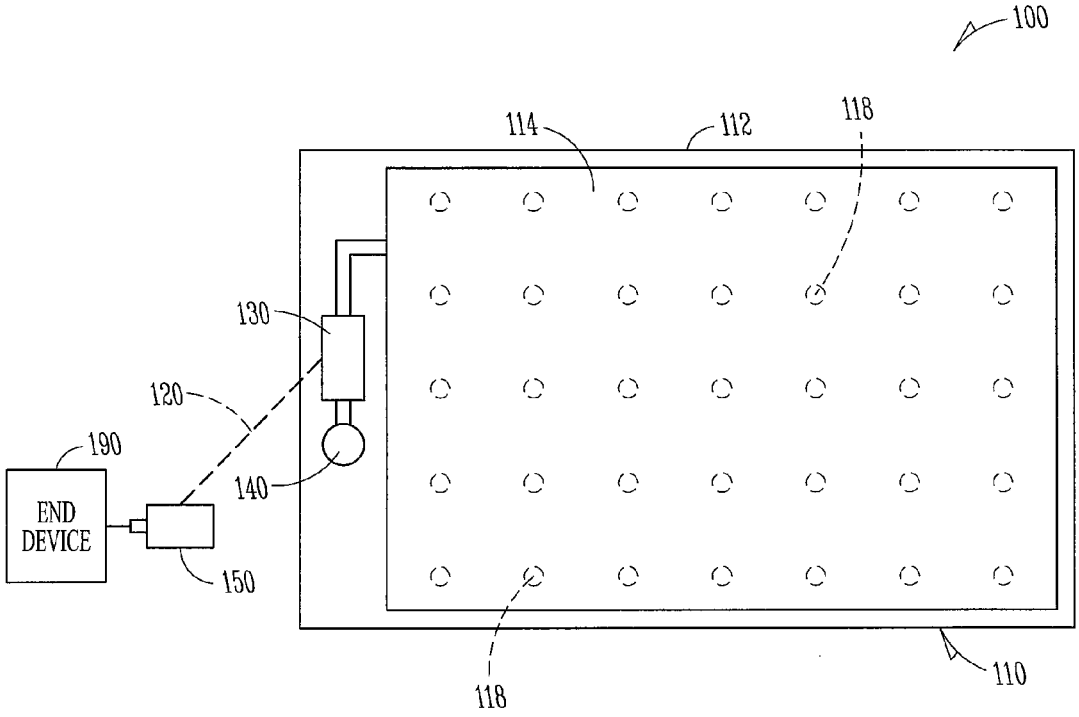
FIG. 1 shows a cut-away top diagrammatic view of a mat system according to an embodiment of the invention.

In the following detailed description, reference is made to the accompanying drawings which form a part hereof, and in which is shown, by way of illustration, specific embodiments in which the invention may be practiced. These embodiments are also referred to herein as "examples." In the drawings, like numerals describe substantially similar components throughout the several views. These embodiments are described in sufficient detail to enable those skilled in the art to practice the invention. Other embodiments may be utilized and structural, or logical changes, etc. may be made without departing from the scope of the present invention.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In the appended claims, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Figure 2:
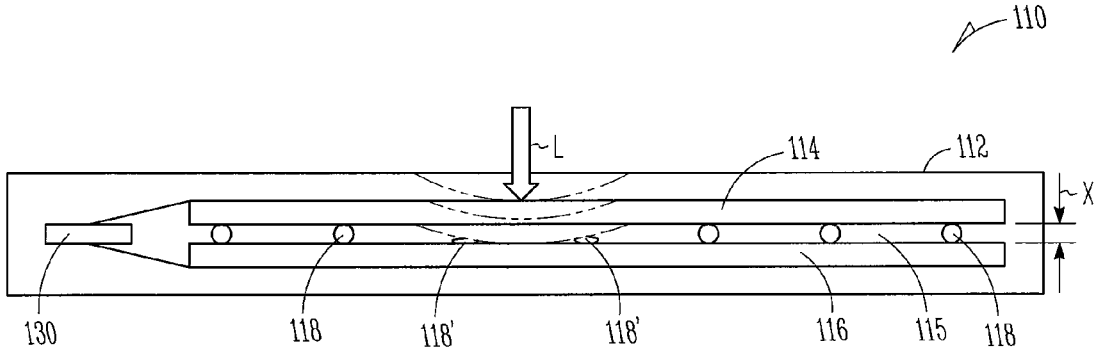
FIG. 2 shows a cut-away side diagrammatic view of a mat of the mat system of FIG. 1.

Referring to FIGS. 1 and 2, in one example, a mat 110 transmits data wirelessly. Referring specifically to FIG. 1, the mat 110 is part of a mat system 100, which includes a wireless connection 120 (shown in phantom) between the mat 110 and an end device 190. Examples of the end device 190 include, but are not limited to, a computer, a control unit for a door or barricade, industrial machinery, an automated teller machine (ATM), or the like.

Referring again to FIGS. 1 and 2, the mat 110 includes a protective covering 112. The protective covering 112, in one example, is formed from polyvinyl chloride (PVC). However, it is contemplated in other examples that the protective covering 112 is formed from other materials, provided the other materials allow the mat 110 to function as described herein. An electronics module 130 is disposed within the protective covering 112. In one example, the electronics module 130 is configured to transmit and/or receive wireless signals to/from a remote source, such as the end device 190 or a device in communication with the end device 190, as is discussed in more detail below. A pair of electrodes 114, 116 is disposed within the protective covering 112. In one example, the electrodes 114, 116 are generally planar and are disposed within the protective covering 112 one on top of the other, with a space 115 therebetween. That is, when viewed from the side the first electrode 114 is disposed above the second electrode 116. In one example, the space 115 is generally free of structures.

Figure 5:
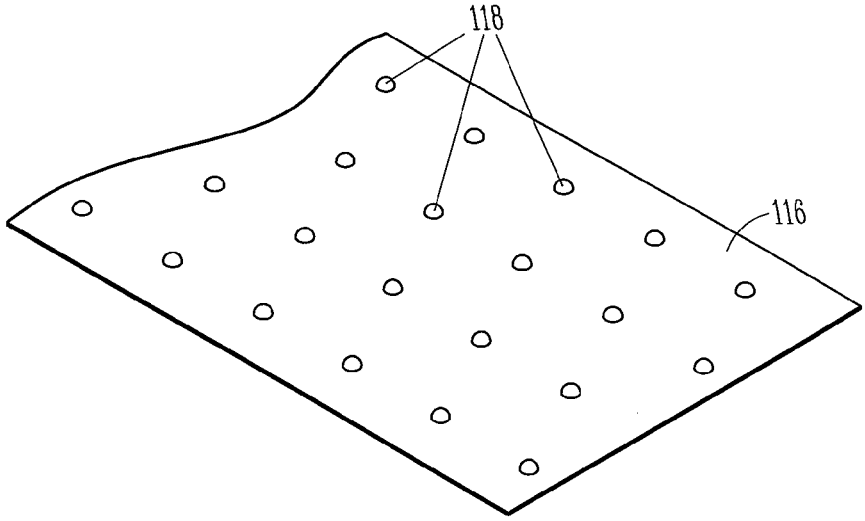
FIG. 5 shows a perspective view of spacing structures disposed on an electrode according to an embodiment of the invention.

Referring now to FIGS. 1, 2, and 5, in another example, the space 115 includes spacing structures 118 to help maintain a normally open circuit spacing between the first and second electrodes 114, 116. In one example, a plurality of spacing structures 118 are disposed between the electrodes 114, 116. In one example, such spacing structures are relatively small in size so as to inhibit the formation of "dead spots" along the mat 110 where a load L can be applied but not cause the electrodes 114, 116 to contact each other. In one example, the spacing structures 118 are relatively small in size to reduce, if not eliminate, the "dead spots" in the mat 110. In one example, the spacing structures 118 have a height of about 1.3 mm.

In one example, the mat 110 can be tuned to have a particular activation load L by placing the spacing structures 118 on the electrodes 114, 116 with a particular distance between the spacing structures 118. In one example, the spacing structures 118, such as silicone dots, are metered out onto one of the electrodes 114, 116 and the other of the electrodes 116, 114 is then placed on top of the spacing structures 118 to essentially sandwich the spacing structures 118 between the electrodes 114, 116. In one example, different activation loads L are attained by altering the distance between the spacing structures 118. For instance, in one example, a smaller distance between spacing structures 118 generally increases the necessary activation load L, and a larger distance between spacing structures 118 generally decreases the necessary activation load L. In one example, the spacing structures 118 are spaced apart from one another by a distance of about 85 mm from center to center. Dispensing and spacing of the spacing structures 118, in one example, is accomplished using a dispensing machine having an electromechanical metered dispensing head to relatively accurately dispense or otherwise place the spacing structures 118 on the electrode at the desired locations therealong.

In one example, the spacing structures 118 are formed from a resilient material. In a further example, the spacing structures 118 are formed entirely from a single resilient material. That is, each of the spacing structures 118 of this example are single component resilient structures and include no other components or elements formed from a different material. In one example, the spacing structures 118 are formed from silicone. In another example, the spacing structures 118 comprise silicone rubber dots. In still another example, the spacing structures 118 are formed from an adhesive such as room temperature vulcanizing (RTV) silicone or some other RTV adhesive. In other examples, the spacing structures 118 are formed from polyurethane or some other such compressible material. In one embodiment, spacing structures 118 are formed from a resilient material to reduce a size or possibility of a dead spot. In one embodiment, spacing structures 118 are placed in a pattern such as an array between electrodes 114, 116. In one example, the spacing structures 118 are generally equally spaced from each other in an array. FIG. 1 shows (in phantom) just one example of such an array, specifically a 7×5 array of spacing structures 118. It should be understood that this example is not intended to be limiting and that other spacing or array configurations are contemplated herein. Silicone rubber dot configurations are relatively inexpensive, and relatively easy to manufacture, in particular when compared to the expense and manufacturing of known electrode spacing techniques.

The spacing structures 118 are configured to maintain a spacing distance X between the electrodes 114, 116 when unloaded and allow the electrodes 114, 116 to contact each other when loaded. In one example, the spacing structures 118 are configured to substantially decrease in height and, in some circumstances, generally flatten when the electrodes are loaded, as depicted in FIG. 2 by spacing structures 118'. In one example, the spacing structures 118 are formed from a material that hardens to a 20 durometer shore A. In another example, the spacing structures 118 are formed from a material that averages about 25 pounds of force to compress to about 10% of its height. In one example, the spacing structures 118 are configured to maintain an original shape when the electrodes 114, 116 are unloaded. For instance, in one example, the spacing structures 118 are configured to remain generally spheroidal when the electrodes 114, 116 are unloaded. In another example, the spacing structures 118 are configured to remain generally spherical when the electrodes 114, 116 are unloaded.

Each of the pair of electrodes 114, 116 is separately electrically connected to the electronics module 130. As described above, the electrodes 114, 116 are separated by the distance X in an open position when unloaded. However, when loaded, such as by a load L, the electrodes 114, 116 are configured to contact each other in a closed position, as depicted in phantom in FIG. 2. That is, at least one of the first and second electrodes 114, 116 are deflectable under a load L, such as, for instance, a foot or other portion of a person, a tire or other portion of a vehicle, a wheel of a wheelchair, etc. In this way, when subjected to such a load L, at least one of the first and second electrodes 114, 116 deflects so that the at least a portion of the first electrode 114 contacts the second electrode 116.

In one example, the electronics module 130 is configured to derive, develop, or otherwise obtain electrode position data by determining whether the electrodes 114, 116 are in the open or closed position. In one example, contacting of the first and second electrodes 114, 116 effectively closes a circuit, which signals to the electronics module 130 that the electrodes 114, 116 are in the closed position and that an object is on the mat 110. Other examples of configurations to obtain electrode positions include but are not limited to detecting a capacitance difference between electrodes, detecting a piezoelectric sensor deflections, etc.

The electronics module 130 is configured to remotely communicate the electrode position data. In one example, the electronics module 130 includes a transmitter to enable the electronics module 130 to transmit data, including the electrode position data, to a remote device. In another example, the electronics module 130 includes a receiver to enable the electronics module 130 to receive data from a remote device. In yet another example, the electronics module 130 includes both a transmitter and a receiver to enable the electronics module 130 to both transmit data to and receive data from a remote device.

In one example, the end device 150 of the system 100 is communicatively coupled to the electronics module 130 of the mat 110. The electronics module 130 is configured to communicate the electrode position data to the end device 190. In one example, the electronics module 130 wirelessly transmits data to or receives data from a remote module 150. In various examples, the remote module 150 can include a receiver, a transmitter, or both. In one example, the remote module 150 is coupled to the end device 190. In one example, the remote module 150 is a wireless receiver/transmitter device connected to the end device 190 using a cable. For instance, the remote module 150 can be connected to the end device 190, such as a computer, using a USB cable. In another example, the remote module 150 includes an interface to connect directly into the end device 190. For instance, the remote module 150 can include a plug or socket that can be engaged with a mating socket or plug of the end device 190, thereby eliminating the cable connection. In yet another example, the remote module 150 is included with the end device 190 as a component thereof. In still another example, the remote module 150 is a wireless receiver/transmitter device wirelessly connected to the end device 190. That is, the remote module 150 can be remote from and in wireless communication with both the mat 110 and the end device 190.

Referring specifically to FIG. 1, in one example, the mat 110 includes a power source, such as a battery 140, electrically coupled to the electronics module 130 to power the electronics module 130 and the electrodes 114, 116. The battery 140 or other power source, in one example, is disposed within the protective covering 112. Because power needs are low, in one embodiment, a battery is completely embedded, and is not replaceable. This configuration improves reliability without a battery access panel that may fail. The cost of fabricating a battery access panel is also saved in manufacturing cost. In another example, the mat 110 is powered by an outside power source, which is connected to the electronics module 130 using a wire or cable.

Referring again to FIGS. 1 and 2, in one example, the electrodes 114, 116 and electronics module 130 are embedded within the protective covering 112. In one example, the battery 140 or other power source is similarly embedded within the protective covering 112. In one example, this is accomplished by integrally molded the protective covering 112 around the electronics module 130, the electrodes 114, 116, and, in some examples, the battery 140. In one example, open cast molding is used to embed components within the protective covering 112. In another example, injection molding is used to embed components within the protective covering 112. In one example, at least a portion of the electronics module 130 is coated in a material to protect the circuitry thereof from the molding (or other) process in order to inhibit the material of the protective covering 112 from interfering with the operation of the circuitry. For instance, coating at least a portion of the electronics module 130 can protect an oscillating circuit to inhibit the material of the protective covering 112 from changing the operational frequency of the transmitter. In one example, a conformal coating is used as a potting material for a portion of the electronics module 130, such as a circuit board.

Figure 3:
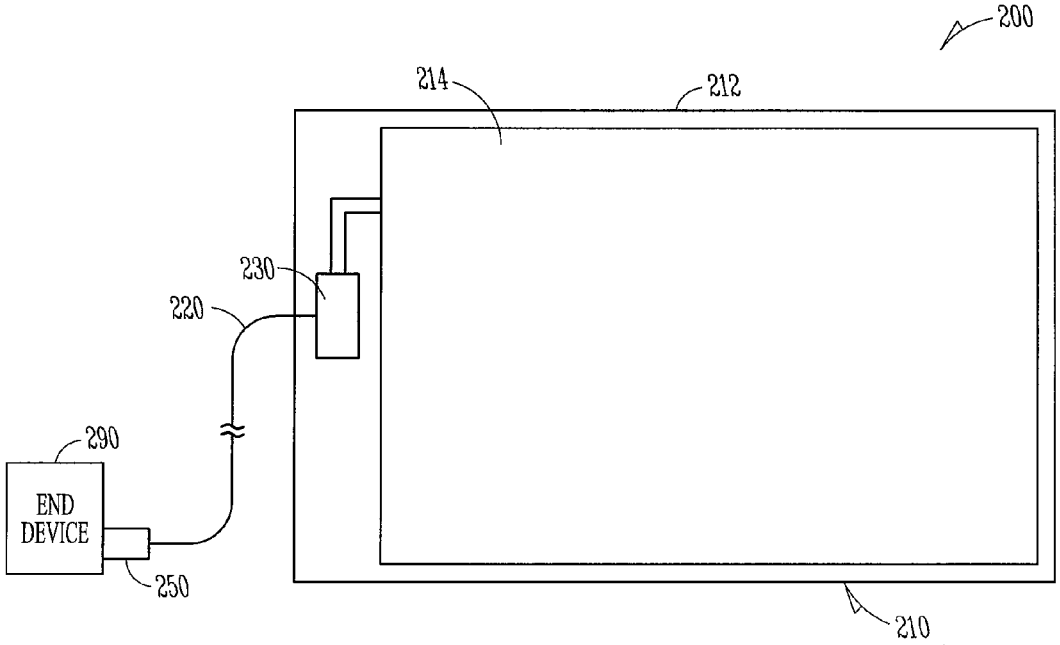
FIG. 3 shows a cut-away top diagrammatic view of a mat system according to an embodiment of the invention.
Figure 4:
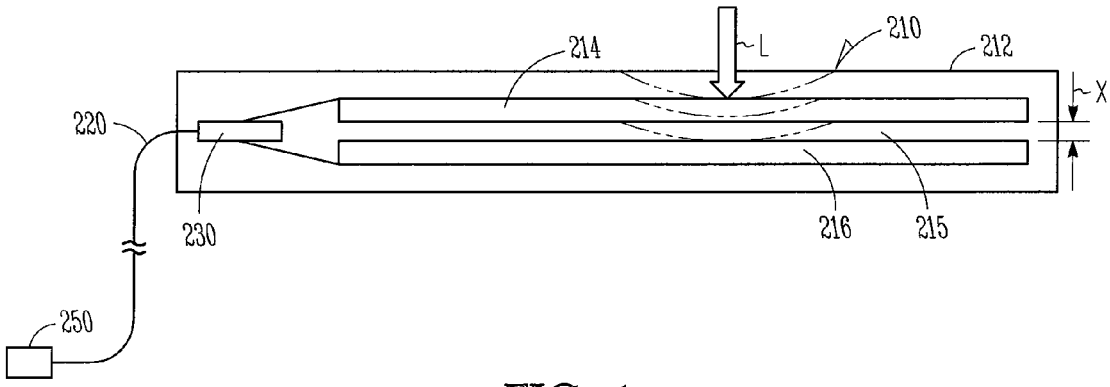
FIG. 4 shows a cut-away side diagrammatic view of a mat of the mat system of FIG. 3.

Referring now to FIGS. 3 and 4, in another example, a mat system 200 includes a mat 210 having a cable 220 exiting therefrom for connection with an end device 290. Many aspects of the mat system 200 and the mat 210 shown in FIGS. 3 and 4 are similar to similarly-labeled aspects of the mat system 100 and the mat 110 shown in FIGS. 1 and 2 and discussed above (reference numbers of similar aspects of the two examples differ by 100). For instance, a first electrode 214 of this example is similar to the first electrode 114 of the example shown in FIGS. 1 and 2. The discussion below is limited to the more dissimilar aspects of the mat system 210 and mat 200. As such, discussion of the largely similar aspects of the mat system 200 and mat 210 is omitted below but can be found with reference to the applicable discussions above regarding the similarly-labeled aspects of the example shown in FIGS. 1 and 2.

One difference between the examples is the presence of the cable 220 to connect the electronics module 230 with the end device 290, rather than having a connection such as the wireless connection 120 discussed above. In one example, the electronics module 230 is configured to remotely communicate using a Universal Serial Bus (USB) cable 220. The electronics module 230 in this example includes USB circuitry to enable communication directly through the USB cable 220 exiting a protective covering 212. In this way, no intermediate circuit is needed in the mat system 200 to convert switch activation to a USB compatible signal. In one example, the mat 210 is connected to an external power source using the cable 220. In this way, no internal power source is needed in the mat 210, such as the battery 140 discussed above in some examples of the mat 110. However, in other examples, the mat 210 can include internal power sources such as batteries.

Referring specifically to FIG. 3, in one example, the cable 220 plugs directly into the end device 290. In one example, the cable 220 is a USB cable 220 having a USB connection 250 for insertion within a USB socket associated with the end device 290. In another example, the cable 220 connects to a module configured to wirelessly transmit data to and/or receive data from the end device 290 in a manner similar to that discussed above. In this way, the cable 220 exiting the protective covering 212 of the mat 210 need not extend the entire distance to the end device 290.

Figure 6:
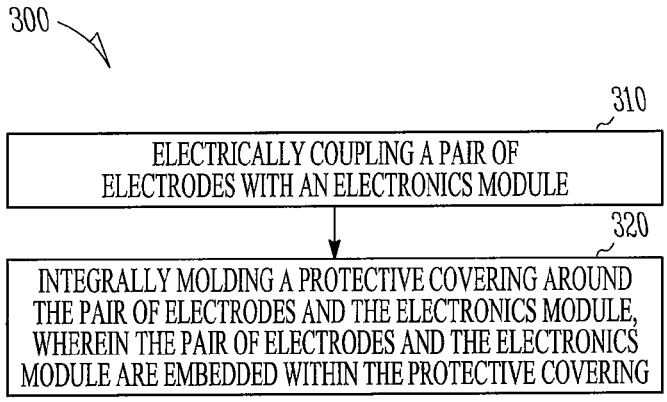
FIG. 6 shows a flowchart of a method according to an embodiment of the invention.

Referring to FIG. 6, in another example, a method 300 of manufacturing a mat (for instance, 110, 210 of FIGS. 1-4) is shown. At 310, a pair of electrodes (for instance, 114, 116, 214, 216 of FIGS. 1-4) is electrically coupled with an electronics module (for instance, 130, 230 of FIGS. 1-4). At 320, a protective covering (for instance, 112, 212 of FIGS. 1-4) is integrally molded around the pair of electrodes and the electronics module, wherein the pair of electrodes and the electronics module are embedded within the protective covering. Molding processes such as open cast molding and injection molding are contemplated, although it is within the spirit and scope of the present disclosure that other techniques are used, provided the mat is capable of performing as discussed herein. In one example, a plurality of spacing structures (for instance, 118 of FIGS. 1 and 2) is placed between the electrodes. In one example, the spacing structures are formed entirely from a single resilient material. Examples of such spacing structures are described in more detail above.

Figure 7:
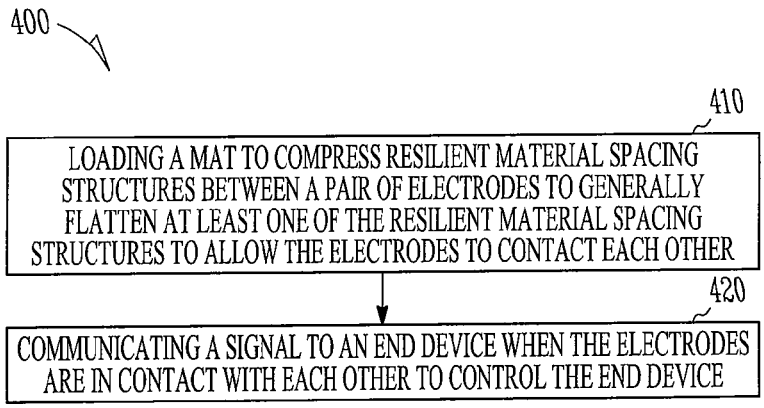
FIG. 7 shows a flowchart of a method according to an embodiment of the invention.

Referring to FIG. 7, in another example, a method 400 of use of a mat (for instance, 110, 210 of FIGS. 1-4) is shown. At 410, a mat is loaded to compress resilient material spacing structures (for instance, 118 of FIGS. 1 and 2) between a pair of electrodes (for instance, 114, 116, 214, 216 of FIGS. 1-4) to generally flatten at least one of the resilient material spacing structures to allow the electrodes to contact each other. At 420, a signal is communicated to an end device when the electrodes are in contact with each other to control the end device (for instance, 130, 230 of FIGS. 1-4). In one example, the method 400 includes unloading the mat to allow the at least one resilient material spacing structure to expand to an original shape to space the electrodes a distance (for instance, X of FIG. 2) away from each other. In one example, loading the mat includes compressing resilient material spacing structures formed from silicone. Other examples of spacing structures are described in more detail above.

With the above discussion in mind, the following is a non-exhaustive list of possible examples of applications for the mat system.

In one example, the mat may control a door. For instance, stepping on the mat can signal a door controller to open the door. Stepping off the mat can alert the door controller that the mat is clear, to allow the door to then close with a decreased chance of hitting something or someone.

In another example, the mat may be used to control a kiosk or similar application. Stepping on the mat will signal the kiosk to start a log-on or will initiate some application. Stepping off the mat will terminate the application or will send out a log-out signal. The mat may be wirelessly connected to the end device, or it may be hard-wired to the end device with a USB cable. In either case the transmitter or the USB device can be embedded into the molded switch mat.

In another example, the mat may be used for determining how long a person is waiting for an attendant or how long they are standing at a teller, etc. by transmitting a start signal when the person steps onto the mat and a stop signal when the person leaves the mat area. The receiver may be attached to a computer or other device that will record the start time and stop time for each event for later analysis.

In other examples, the mat may be used for machine safety to successfully reduce hazards in a number of industries in machine point-of-operation, area and perimeter guarding applications, including:

Robotic Welding,
Laser Welding/Cutting,
Water Jet Machines,
Pick and Place Robots,
Plastics Molding Machines,
Assembly Machines,
Automated Material Handling,
Packaging Machinery,
Textile Machinery,
Conveyers,
Paper Converting Machinery, and
CNC Punches & Tube Benders.

In still other examples, the mat may be used in the following applications:

Drive Up Windows,
Vehicle Detection & Position Verification,
Cash Register Security,
Toll Booth Barricade Activation,
Car Wash Activation, and
Process Signaling.

Wireless configurations enable simple mat installation without the need for routing wires around a doorframe, or other objects. Embodiments with battery power further facilitate installation and improve reliability by keeping all components embedded within a protective covering. USB configurations enable easy mat installation and control by reducing a number of components necessary to interface with a controller or computer. Other benefits of configurations shown include, but are not limited to:

Increased safety—the above-discussed mats (for example, mats used to trigger automatic doors) offer positive control and a well-defined activation area. Other methods of presence sensing such as the use of sensors require motion or movement, which means anyone who pauses in the activation or safety zone may not be detected. Such a malfunction is less likely with the above-discussed mats because such mats should detect a person, including small children, the disabled, and the elderly, who steps or otherwise becomes disposed on the mat.

Increased reliability—Because the above-discussed mats offer positive control, mats (for example, mats used to trigger automatic doors) are generally more reliable than other methods of presence sensing such as the use of optical sensors such as light curtains, which can be influenced by blowing debris, fall out of adjustment, and require additional maintenance. The above-discussed mats are also configured to function for an extended amount of time and accept relatively high loads.

Decreased cost—the above-discussed mats have a lower initial cost and lower costs for maintenance and service than other methods of presence sensing such as the use of sensors. Moreover, the above-discussed mats can help control costs through fewer phantom activations.

The above description is intended to be illustrative, and not restrictive. For example, the above-described examples (or one or more aspects thereof) may be used in combination with each other. Combinations of the above embodiments, and other embodiments will be apparent to those of skill in the art upon reviewing the above description. Other embodiments can be used, such as by one of ordinary skill in the art upon reviewing the above description. While a number of advantages of embodiments described herein are listed above, the list is not exhaustive. Other advantages of embodiments described above will be apparent to one of ordinary skill in the art, having read the present disclosure. Although specific embodiments have been illustrated and described herein, it will be appreciated by those of ordinary skill in the art that any arrangement which is calculated to achieve the same purpose may be substituted for the specific embodiment shown. This application is intended to cover any adaptations or variations of the present invention.

The Abstract is provided to comply with 37 C.F.R. §1.72 (b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment. The scope of the invention includes any other applications in which the above structures and fabrication methods are used. The scope of the invention should be determined with reference to the appended claims, along with the full scope of equivalents to which such claims are entitled.

What is claimed is:

1. An apparatus, comprising:

a seamless protective covering;

an electronics module at least partially disposed within the protective covering;

a pair of electrodes disposed within the protective covering, the pair of electrodes electrically connected to the electronics module, wherein the electrodes and electronics module are embedded within the protective covering, which is integrally molded therearound; and a plurality of spacing structures disposed between the electrodes, the spacing structures formed entirely from a single resilient material, the spacing structures configured to maintain a spacing distance between the electrodes when unloaded and allow the electrodes to contact each other when loaded, the spacing structures being further configured to reduce dead spots, wherein the electronics module is configured to communicate an electrode loading condition with an end device, wherein, with a loaded electrode condition, the end device is configured to initiate a software application, and, with an unloaded electrode condition, the end device is configured to terminate the software application, wherein the software application is configured to run only with the loaded electrode condition.

2. The apparatus of claim 1, wherein the spacing structures are generally equally spaced from each other in an array.

3. The apparatus of claim 1, wherein the spacing structures are formed from silicone.

4. The apparatus of claim 3, wherein the spacing structures comprise silicone rubber dots.

5. The apparatus of claim 1, wherein the spacing structures are configured to generally flatten when the electrodes are loaded.

6. The apparatus of claim 1, wherein the spacing structures are configured to remain generally spheroidal when the electrodes are unloaded.

7. A system, comprising:

a mat including:

a protective covering;

a pair of electrodes disposed within the protective covering;

a plurality of spacing structures disposed between the electrodes, the spacing structures formed entirely from a single resilient material, the spacing structures configured to maintain a spacing distance between the electrodes when unloaded and allow the electrodes to contact each other when loaded, the spacing structures being further configured to reduce dead spots; and an electronics module at least partially disposed within the protective covering, the electronics module electrically coupled to the pair of electrodes, the electronics module configured to determine whether the electrodes are loaded or unloaded to obtain electrode position data; and an end device communicatively coupled to the electronics module of the mat, wherein the electronics module is configured to communicate the electrode position data to the end device, wherein, with communication of loaded electrode position data, the end device is configured to initiate a software application, and, with communication of unloaded electrode position data, the end device is configured to terminate the software application, wherein the software application is configured to run only with communication of the loaded electrode position data.

8. The system of claim 7, wherein the spacing structures are generally equally spaced from each other in an array.

9. The system of claim 7, wherein the spacing structures are formed from silicone.

10. The system of claim 9, wherein the spacing structures comprise silicone rubber dots.

11. The system of claim 7, wherein the electronics module is configured to remotely communicate the electrode position data.

12. The system of claim 11, wherein the electronics module is configured to remotely communicate wirelessly.

13. The system of claim 11, wherein the electronics module is configured to remotely communicate using a USB cable.

14. The system of claim 7, wherein the electrodes and electronics module are embedded within the protective covering, which is integrally molded therearound.

15. A method, comprising:

loading a mat to compress resilient material spacing structures between a pair of electrodes to generally flatten at least one of the resilient material spacing structures to allow the electrodes to contact each other;

communicating a signal to an end device when the electrodes are in contact with each other to control the end device; and initiating a software application to run on the end device while the electrodes are in contact with each other, wherein the end device is configured to terminate the software application when the electrodes separate with unloading of the mat, wherein the software application is configured to run only while the electrodes are in contact with each other.

16. The method of claim 15, comprising unloading the mat to allow the at least one resilient material spacing structure to expand to an original shape to space the electrodes a distance away from each other.

17. The method of claim 15, wherein loading the mat includes compressing resilient material spacing structures formed from silicone.

18. An apparatus, comprising:

a protective covering;

an electronics module disposed within the protective covering; and a pair of electrodes disposed within the protective covering, the pair of electrodes electrically connected to the electronics module, the electrodes separated by a distance in an open position when unloaded, the electrodes configured to contact each other in a closed position when loaded, wherein the electronics module is configured to obtain electrode position data by determining whether the electrodes are in the open or closed position, the electronics module being configured to remotely communicate the electrode position data to an end device, wherein the electrodes and electronics module are embedded within the protective covering, which is integrally molded therearound, wherein, with the electrodes in the closed position, the end device is configured to initiate a software application, and, with electrodes in the open position, the end device is configured to terminate the software application, wherein the software application is configured to run only with the electrodes in the closed position.

19. The apparatus of claim 18, wherein the electronics module is configured to remotely communicate wirelessly.

20. The apparatus of claim 18, wherein the electronics module is configured to remotely communicate using a USB cable.

21. The apparatus of claim 18, comprising a plurality of spacing structures disposed between the electrodes, the spacing structures formed entirely from a single resilient material, the spacing structures configured to maintain the distance between the electrodes when unloaded and allow the electrodes to contact each other when loaded, the spacing structures being further configured to reduce dead spots.

22. A system, comprising:

a mat including:

a seamless protective covering;

a pair of electrodes within the protective covering, the electrodes having an open position when unloaded and a closed position when loaded; and an electronics module within the protective covering and electrically coupled to the electrodes, the electronics module configured to determine whether the electrodes are in the open or closed position to obtain electrode position data, wherein the electrodes and electronics module are embedded within the protective covering which is integrally molded therearound; and an end device communicatively coupled to the electronics module of the mat, wherein the electronics module is configured to communicate the electrode position data to the end device, wherein, with communication of loaded electrode position data, the end device is configured to initiate a software application, and, with communication of unloaded electrode position data, the end device is configured to terminate the software application, wherein the software application is configured to run only with communication of the loaded electrode position data.

23. The mat system of claim 22, wherein the end device is wirelessly coupled to the electronics module of the mat.

24. The mat system of claim 22, wherein the end device is coupled to the electronics module of the mat with a USB cable.

25. A method, comprising:

electrically coupling a pair of electrodes with an electronics module;

integrally molding a seamless protective covering around the pair of electrodes and the electronics module, wherein the pair of electrodes and the electronics module are embedded within the protective covering, the electrodes including an open position when unloaded and a closed position when loaded, the electronics module configured to determine whether the electrodes are in the open or closed position to obtain electrode position data; and communicatively coupling the electronics module with an end device, wherein, with communication of loaded electrode position data, the end device is configured to initiate a software application, and, with communication of unloaded electrode position data, the end device is configured to terminate the software application, wherein the software application is configured to run only with communication of the loaded electrode position data.

26. The method of claim 25, wherein integrally molding includes open cast molding.

27. The method of claim 25, wherein integrally molding includes injection molding.

28. The method of claim 25, comprising placing a plurality of spacing structures between the electrodes, the spacing structures formed entirely from a single resilient material.

* * * * *